US012532909B2

(12) United States Patent
Ki et al.

(10) Patent No.: US 12,532,909 B2
(45) Date of Patent: Jan. 27, 2026

(54) AEROSOL GENERATING ARTICLE INCLUDING THERMALLY CONDUCTIVE WRAPPER

(71) Applicant: KT&G CORPORATION, Daejeon (KR)

(72) Inventors: Sung Jong Ki, Daejeon (KR); Young Joong Kim, Daejeon (KR); In Su Park, Seoul (KR); John Tae Lee, Seoul (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 709 days.

(21) Appl. No.: 17/432,713

(22) PCT Filed: Jul. 31, 2020

(86) PCT No.: PCT/KR2020/010145
§ 371 (c)(1),
(2) Date: Aug. 20, 2021

(87) PCT Pub. No.: WO2021/025391
PCT Pub. Date: Feb. 11, 2021

(65) Prior Publication Data

US 2022/0160023 A1 May 26, 2022

(30) Foreign Application Priority Data

Aug. 8, 2019 (KR) ..... 10-2019-0096912

(51) Int. Cl.
*A24D 1/20* (2020.01)
*A24D 1/02* (2006.01)
*A24D 3/17* (2020.01)

(52) U.S. Cl.
CPC ..... *A24D 1/20* (2020.01); *A24D 1/02* (2013.01); *A24D 1/025* (2013.01); *A24D 3/17* (2020.01)

(58) Field of Classification Search
None
See application file for complete search history.

(56) References Cited

U.S. PATENT DOCUMENTS 7,647,932 B2 1/2010 Cantrell et al.
10,159,277 B2 12/2018 Bonnely
(Continued)

FOREIGN PATENT DOCUMENTS

CN 207604513 U 7/2018
CN 108366616 A 8/2018
(Continued)

OTHER PUBLICATIONS

Office Action dated Nov. 1, 2022 issued by the Japanese Patent Office in Japanese Application No. 2021-551991.
(Continued)

*Primary Examiner* — Philip Y Louie
*Assistant Examiner* — Nicole A Szumigalski
(74) *Attorney, Agent, or Firm* — Sughrue Mion, PLLC

(57) ABSTRACT

The present disclosure relates to an aerosol generating article for use with an aerosol generating device, and to an aerosol generating article including a thermally conductive wrapper. An aerosol generating article according to one aspect includes an aerosol substrate section containing an aerosol generating material without nicotine, a medium disposed toward a downstream end of the aerosol substrate section and containing nicotine, a cooler disposed toward a downstream end of the medium, a filter disposed toward a downstream end of the cooler, and a wrapper surrounding at least part of the aerosol generating article, wherein the
(Continued)

wrapper includes a thermally conductive wrapper surrounding at least part of the aerosol substrate section and the medium.

10 Claims, 5 Drawing Sheets

(56) References Cited

U.S. PATENT DOCUMENTS

| | | | | |
|---|---|---|---|---|
| 10,426,191 | B2 | 10/2019 | Lavanant et al. | |
| 10,820,633 | B2 | 11/2020 | Reevell | |
| 11,076,633 | B2 | 8/2021 | Mohseni | |
| 2013/0306085 | A1* | 11/2013 | Sanchez | A24D 3/04 493/39 |
| 2015/0040924 | A1 | 2/2015 | Mironov et al. | |
| 2016/0143355 | A1 | 5/2016 | Borges et al. | |
| 2016/0316816 | A1* | 11/2016 | Lavanchy | A24D 1/22 |
| 2017/0340015 | A1 | 11/2017 | Thorens | |
| 2017/0340018 | A1 | 11/2017 | Thorens | |
| 2018/0077966 | A1 | 3/2018 | Malgat et al. | |
| 2018/0184713 | A1* | 7/2018 | Mironov | A24F 40/30 |
| 2019/0000142 | A1 | 1/2019 | Lavanchy et al. | |
| 2019/0014813 | A1 | 1/2019 | Carraro et al. | |
| 2019/0098927 | A1 | 4/2019 | Mironov | |
| 2019/0159517 | A1 | 5/2019 | Ballesteros Gomez et al. | |
| 2019/0191780 | A1* | 6/2019 | Wilke | H05B 6/105 |
| 2020/0352231 | A1 | 11/2020 | Han et al. | |
| 2021/0106051 | A1 | 4/2021 | Han et al. | |
| 2022/0039458 | A1* | 2/2022 | Lavanchy | B32B 7/027 |
| 2022/0175015 | A1* | 6/2022 | Jeong | A24F 40/465 |

FOREIGN PATENT DOCUMENTS

| | | | | |
|---|---|---|---|---|
| CN | 108601397 | A | 9/2018 | |
| CN | 105813482 | B | 10/2018 | |
| JP | 2009-502194 | A | 1/2009 | |
| KR | 10-2015-0139977 | A | 12/2015 | |
| KR | 10-2018-0070450 | A | 6/2018 | |
| KR | 10-2018-0070512 | A | 6/2018 | |
| KR | 10-2018-0111460 | A | 10/2018 | |
| KR | 10-2018-0135927 | A | 12/2018 | |
| KR | 10-2019-0021439 | A | 3/2019 | |
| KR | 10-2019-0089896 | A | 7/2019 | |
| TW | 201524380 | A | 7/2015 | |
| TW | 201912404 | A | 4/2019 | |
| TW | I657753 | B | 5/2019 | |
| WO | 2017/207585 | A1 | 12/2017 | |
| WO | 2018/224679 | A1 | 12/2018 | |
| WO | WO-2019048361 | A1 * | 3/2019 | A24D 1/02 |
| WO | 2019/105750 | A1 | 6/2019 | |
| WO | 2019/123048 | A1 | 6/2019 | |
| WO | 2019/129694 | A1 | 7/2019 | |
| WO | WO-2020153829 | A1 * | 7/2020 | A24B 15/16 |

OTHER PUBLICATIONS

Chinese Office Action issued Sep. 11, 2023 in Application No. 202080018375.4.

Chinese Office Action dated Apr. 20, 2023 in Chinese Application No. 202080018375.4.

Office Action dated May 31, 2021 from the Intellectual Property Office of Taiwan in TW Application No. 109126949.

Extended European Search Report dated Feb. 22, 2022 from the European Patent Office in EP Application No. 20849316.3.

Korean Notification of Reason for Refusal for 10-2019-0096912 dated, Mar. 26, 2021.

International Search Report for PCT/KR2020/010145 dated, Nov. 19, 2020 (PCT/ISA/210).

Written Opinion of the International Searching Authority for PCT/KR2020/010145 dated, Nov. 19, 2020 (PCT/ISA/237).

* cited by examiner

【Figure 1A】
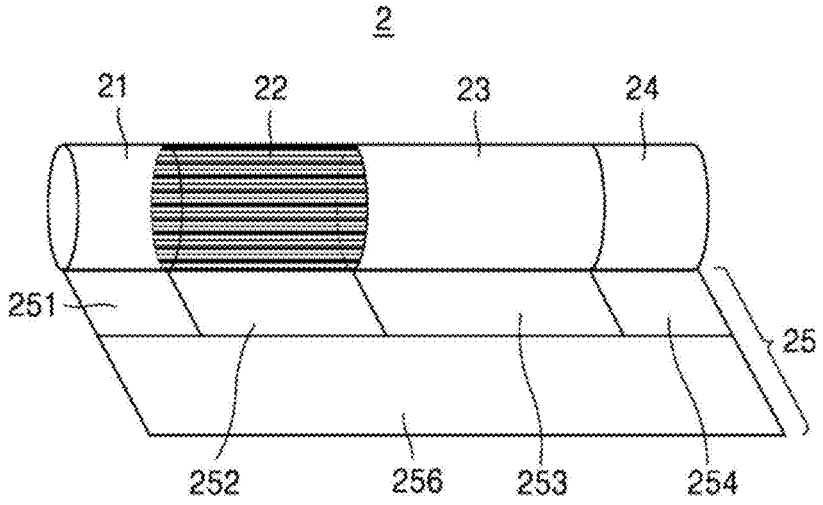
【Figure 1B】
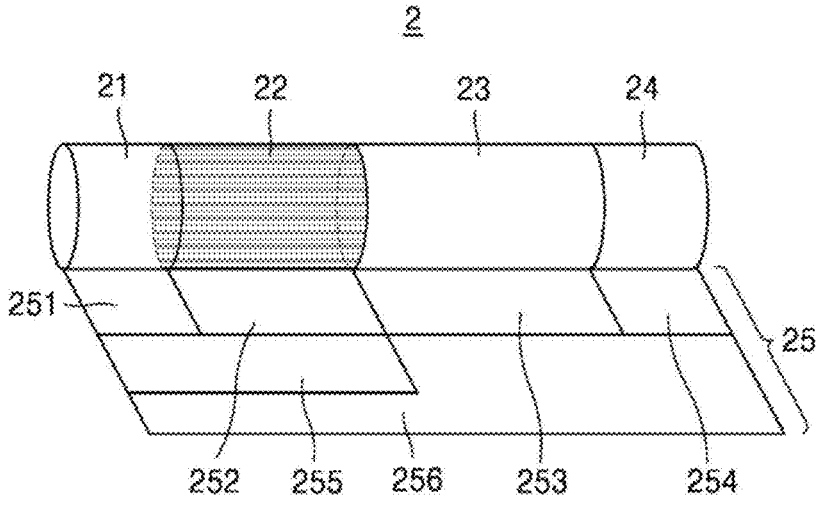

【Figure 2A】
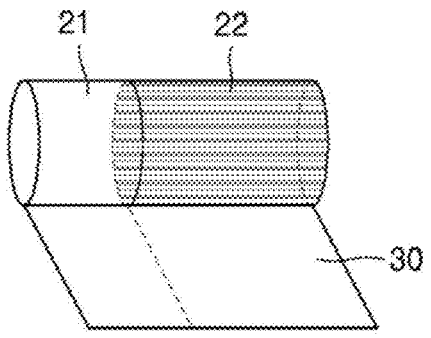
【Figure 2B】
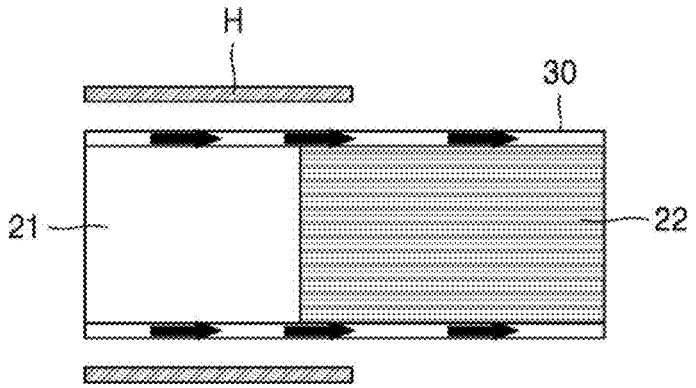
【Figure 3A】
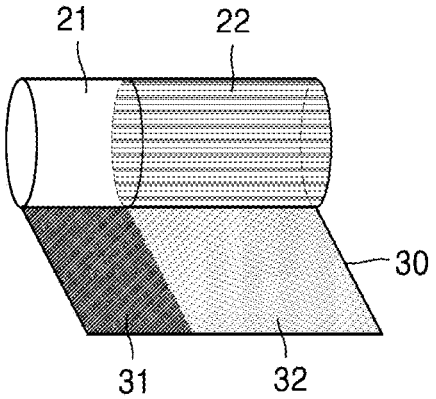

【Figure 3B】
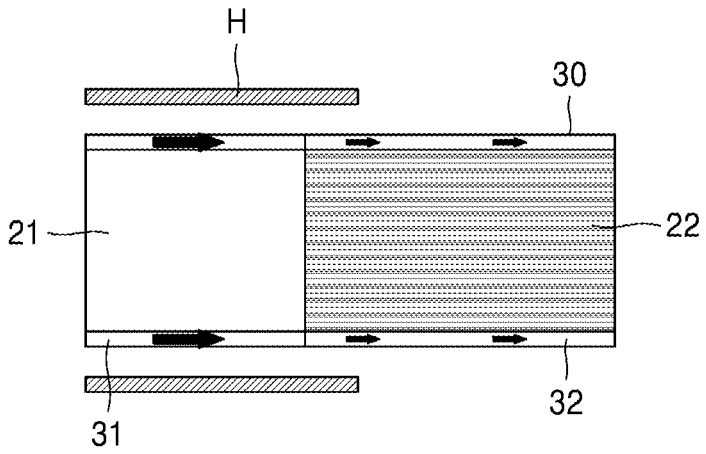
【Figure 4A】
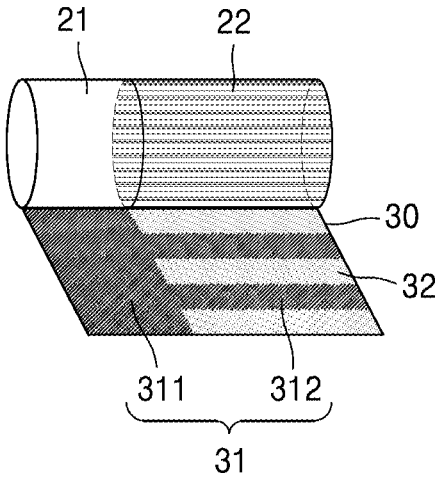

【Figure 4B】
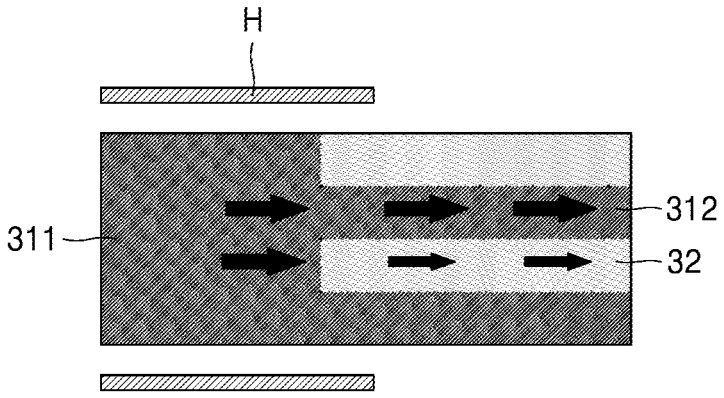
【Figure 5A】
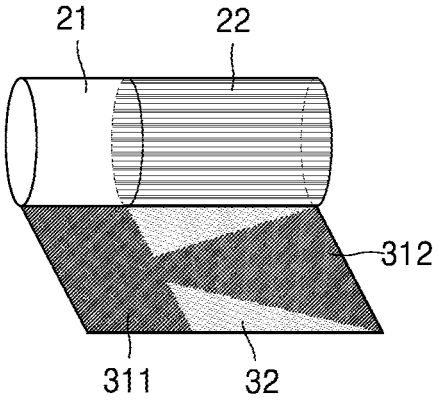
【Figure 5B】
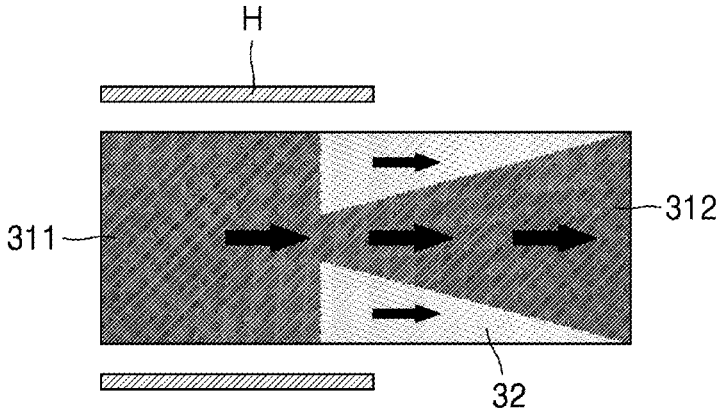

【Figure 6A】
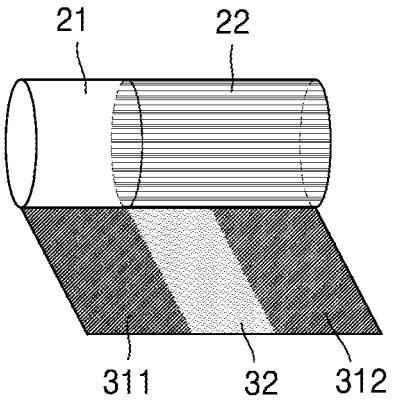
【Figure 6B】
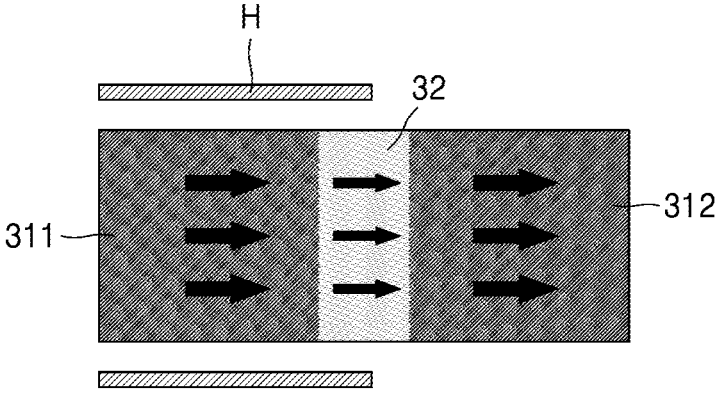

AEROSOL GENERATING ARTICLE INCLUDING THERMALLY CONDUCTIVE WRAPPER

TECHNICAL FIELD

The present disclosure relates to an aerosol generating article for use with an aerosol generating device, and particularly, to an aerosol generating article including a thermally conductive wrapper.

BACKGROUND ART

Recently, the demand for alternatives to traditional combustive cigarettes has increased. For example, there is growing demand for aerosol generating devices that generate aerosol by heating an aerosol generating material in cigarettes, rather than by combusting cigarettes. Accordingly, studies on a heating-type cigarette and a heating-type aerosol generating device have been actively conducted.

DISCLOSURE

Technical Solution

The present disclosure provides an aerosol generating article which includes a portion containing nicotine and another portion containing an aerosol generating material without nicotine.

In addition, the present disclosure provides an aerosol generating article including a thermally conductive wrapper.

The technical problem is not limited to the above description, and other technical problems may be inferred from the following examples.

According to one aspect, an aerosol generating article for generating an aerosol by being heated by an aerosol generating device includes: an aerosol substrate section containing an aerosol generating material without nicotine; a medium disposed to face a downstream end of the aerosol substrate section and containing the nicotine; a cooler disposed to face a downstream end of the medium; a filter disposed to face a downstream end of the cooler; and a thermally conductive wrapper surrounding at least part of the aerosol substrate section and the medium.

Advantageous Effects

Since an aerosol substrate section and a medium are spatially separated from each other, the aerosol substrate section and the medium may be respectively heated to different temperatures.

In addition, an aerosol substrate section and a medium may be heated to different temperatures by a thermally conductive wrapper with a single heater.

Therefore, an aerosol generating material of an aerosol substrate section may be heated to an appropriate temperature for generating aerosol, while nicotine of a medium may also be heated to an appropriate temperature to generate a good taste of tobacco desired by a user.

DESCRIPTION OF DRAWINGS

FIGS. 1A and 1B illustrate examples of an aerosol generating article;

FIGS. 2A and 2B illustrate one example of an aerosol substrate section and a medium wrapped by a thermally conductive wrapper;

FIGS. 3A and 3B illustrate one example of an aerosol substrate section and a medium wrapped by a thermally conductive wrapper;

FIGS. 4A and 4B illustrate one example of an aerosol substrate section and a medium wrapped by a thermally conductive wrapper;

FIGS. 5A and 5B illustrate one example of an aerosol substrate section and a medium wrapped by a thermally conductive wrapper; and FIGS. 6A and 6B illustrate one example of an aerosol substrate section and a medium wrapped by a thermally conductive wrapper.

BEST MODE

An aerosol generating article for generating aerosol when heated by an aerosol generating device according to one aspect includes an aerosol substrate section containing an aerosol generating material without nicotine; a medium disposed to face a downstream end of the aerosol substrate section and containing the nicotine; a cooler disposed to face a downstream end of the medium; a filter disposed to face a downstream end of the cooler; and a thermally conductive wrapper surrounding at least part of the aerosol substrate section and the medium.

In the aerosol generating article described above, the thermally conductive wrapper includes a first portion and a second portion that do not overlap each other, and the first portion and the second portion have the same thermal conductivity.

In the aerosol generating article described above, the thermally conductive wrapper includes a first portion and a second portion that do not overlap each other, and the first portion and the second portion have different thermal conductivities from each other.

In the aerosol generating article described above, only one of the first portion and the second portion contains a thermally conductive material.

In the aerosol generating article described above, one of the first portion and the second portion has a greater amount of thermally conductive material per unit area than the other of the first portion and the second portion.

In the aerosol generating article described above, one of the first portion and the second portion contains a thermally conductive material with a higher thermal conductivity than the other of the first portion and the second portion.

In the aerosol generating article described above, the first portion surrounds the aerosol substrate section and the second portion surrounds the medium.

In the aerosol generating article described above, the first portion includes a first sub-portion surrounding the aerosol substrate section and a second sub-portion surrounding part of the medium, and the second portion surrounds a remaining portion of the medium that is not surrounded by the second sub-portion of the first portion.

In the aerosol generating article described above, the second sub-portion extends from an upstream end of the medium to a downstream end of the medium.

In the aerosol generating article described above, at least part of the second sub-portion is not constant in width.

In the aerosol generating article described above, the second portion is disposed between the first sub-portion and the second sub-portion.

Mode for Invention

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

In the following embodiments, the term "downstream" refers to a direction in which air and/or aerosol flows in an aerosol generating article when a user puffs on the aerosol generating article, and the term "upstream" refers to an opposite direction to the downstream direction. The terms "upstream" and "downstream" may be used to indicate the relative position or direction between segments that configure the aerosol generating article.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1A and 1B illustrate examples of an aerosol generating article.

The aerosol generating article 2 may generate aerosol when heated by an aerosol generating device. The aerosol generating article 2 may include an aerosol substrate section 21, a medium 22, a cooler 23, a filter 24, and a wrapper 25.

The aerosol substrate section 21 may not contain nicotine. In addition, the aerosol substrate section 21 may contain an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the aerosol substrate section 21 may contain other additives, such as a savoring agent, a wetting agent and/or organic acid. In addition, the aerosol substrate section 21 may contain a flavored liquid such as menthol or moisturizer.

The aerosol substrate section 21 may include a crimp sheet, and the aerosol generating material may be included in the aerosol substrate section 21 in a state of being absorbed by the crimp sheet. In addition, other additives such as a savoring agent, a wetting agent, and/or organic acid, and a flavored liquid may be contained in the aerosol substrate section 21 in a state of being absorbed by a crimp sheet.

A length of the aerosol substrate section 21 may be appropriately selected within a range of 4 mm to 12 mm but is not limited thereto.

The medium 22 may contain nicotine. In addition, the medium 22 may contain an aerosol generating material such as glycerin. In addition, the medium 22 may contain other additives such as a savoring agent, a wetting agent, and/or organic acid. In addition, a flavored liquid such as menthol or moisturizer may be added to the medium 22 by being sprayed onto the medium 22.

The medium 22 may be manufactured in various forms. For example, the medium 22 may be formed using a sheet or strands. Also, the medium 22 may be formed using tiny bits cut from a tobacco sheet.

A length of the medium 22 may be appropriately selected within a range of 6 mm to 18 mm but is not limited thereto.

The cooler 23 may cool aerosol. Therefore, a user may inhale aerosol cooled to an appropriate temperature.

For example, the cooler 23 may be made of cellulose acetate and may be a tube-shaped structure including a hollow therein. For example, the cooler 23 may be made by adding a plasticizer (for example, triacetin) to cellulose acetate tow. For example, mono denier of the cooler 23 may be 5.0, and total denier thereof may be 28,000.

For example, the cooler 23 is made of paper and may be a tube-shaped structure including a hollow therein.

A diameter of the hollow included in the cooler 23 may be appropriately selected within a range of 4 mm to 8 mm but is not limited thereto. A length of the cooler 23 may be appropriately selected within a range of 4 mm to 30 mm, but is not limited thereto.

The cooler 23 is not limited to the above-described example and may be applicable without limitation as long as aerosol may be cooled.

The filter 24 may be made by adding a plasticizer (for example, triacetin) to cellulose acetate tow. For example, mono denier of the filter 24 may be 9.0, and total denier thereof may be 25,000. A length of the filter 24 may be appropriately selected within a range of 4 mm to 30 mm, but is not limited thereto.

The filter 24 may be formed to generate flavors. For example, a flavoring liquid may be injected onto the filter 24, or an additional fiber coated with a flavoring liquid may be inserted into the filter 24.

Also, the filter 24 may include at least one capsule. Here, the capsule may generate a flavor and/or aerosol. For example, the capsule may have a configuration in which a liquid containing a flavoring material is wrapped with a film. For example, the capsule may have a spherical or cylindrical shape, but is not limited thereto.

For example, the aerosol generating article 2 may be packaged via one wrapper 25. The wrapper 25 may have at least one hole through which external air may be introduced or internal air may be discharged.

For example, as illustrated in FIG. 1A, the aerosol substrate section 21 may be wrapped by a first wrapper 251, the medium 22 may be wrapped by a second wrapper 252, the cooler 23 may be wrapped by a third wrapper 253, and the filter 24 may be wrapped by a fourth wrapper 254. In addition, the entire aerosol generating article 2 may be rewrapped by a sixth wrapper 256.

Alternatively, as illustrated in FIG. 1B, the aerosol substrate section 21 and the medium 22 may be rewrapped by a fifth wrapper 255, and the entire aerosol generating article 2 may be rewrapped by the sixth wrapper 256.

The first wrapper 251 may be made by coupling a metal foil such as aluminum foil to general filter wrapping paper. For example, a thickness of the metal foil of the first wrapper 251 may be in a range of 6 μm to 20 μm, and a total thickness of the first wrapper 251 may be in a range of 40 μm to 80 μm.

The second wrapper 252 and the third wrapper 253 may be made of porous paper.

For example, porosity of the second wrapper 252 may be 35000 CU, but is not limited thereto. In addition, a thickness of the second wrapper 252 may be in a range of 70 μm to 80 μm. In addition, a basis weight of the second wrapper 252 may be in a range of 20 $g/m^2$ to 25 $g/m^2$.

For example, porosity of the third wrapper 253 may be 35000 CU, but is not limited thereto. In addition, a thickness of the third wrapper 253 may be in a range of 70 μm to 80 μm. In addition, a basis weight of the third wrapper 253 may be in a range of 20 $g/m^2$ to 25 $g/m^2$.

In addition, the second wrapper 252 may be made by coupling a metal foil such as an aluminum foil to general filter wrapping paper.

In addition, the second wrapper 252 may be made of sterile paper (MFW).

The fourth wrapper 254 may be made of PLA laminated paper. Here, the PLA laminated paper means three-layer paper including a paper layer, a PLA layer and a paper layer. For example, a thickness of the fourth wrapper 254 may be in a range of 100 μm to 120 μm. In addition, a basis weight of the fourth wrapper 254 may be in a range of 80 $g/m^2$ to 100 $g/m^2$.

The fifth wrapper 255 may be made by coupling a metal foil such as an aluminum foil to general filter wrapping paper. For example, the entire thickness of the fifth wrapper 255 may be included in a range of 60 μm to 70 μm. In addition, a thickness of a metal foil of the fifth wrapper 255 may be included in a range of 10 μm to 30 μm.

The sixth wrapper 256 may be made of sterile paper (MFW). For example, a basis weight of the sixth wrapper 256 may be included in a range of 57 g/m2 to 63 g/m2. In addition, a thickness of the sixth wrapper 256 may be included in a range of 64 μm to 70 μm.

The wrapper 25 is not limited to the configuration illustrated in FIGS. 1A and 1B.

For example, the wrapper 25 may not include the first wrapper 251 and the second wrapper 252. The aerosol substrate section 21 and the medium 22 may be wrapped by the fifth wrapper 255 without the first wrapper 251 and the second wrapper 252.

For example, the fifth wrapper 255 may include a plurality of wrappers. The aerosol substrate section 21 and the medium 22 may be respectively wrapped by the first wrapper 251 and the second wrapper 252, and may be respectively rewrapped by a plurality of wrappers of the fifth wrapper 255.

For example, the aerosol generating article 2 may not include the third wrapper 253. For example, the cooler 23 may be made of paper and wrapped by the sixth wrapper 256 without the third wrapper 253.

In the aerosol generating article 2, the aerosol substrate section 21 contains an aerosol generating material without nicotine, and the medium 22 contains nicotine. If the medium 22 is heated to a temperature suitable for the aerosol substrate section 21 to generate aerosol, a burnt taste may be provided to a user. On the other hand, if the aerosol substrate section 21 is heated to a temperature suitable for the medium 22 to provide a proper taste of tobacco desired by a user, a sufficient amount of aerosol may not be generated. Therefore, the aerosol substrate section 21 containing the aerosol generating material (for example, glycerin) and the medium 22 containing nicotine need to be heated to different temperatures.

To this end, in the aerosol generating article 2 according to an embodiment, the aerosol substrate section 21 and the medium 22 may be spatially separated from each other, so that they can be heated to different temperatures by different heaters. For example, when the aerosol substrate section 21 is heated to a temperature of 150° C. or higher by a heater to generate a sufficient amount of aerosol, the medium 22 may be heated to a temperature of 120° C. or higher by another heater to provide nicotine and a taste of tobacco desired by a user.

However, when an aerosol generating device includes a single heater, it may be difficult for the aerosol substrate section 21 and the medium 22 to be heated to different temperatures. For example, if the aerosol substrate section 21 and the medium 22 are heated to approximately 150° C. by a single heater, a taste of tobacco generated from the medium 22 may not be satisfactory. On the other hand, if the aerosol substrate section 21 and the medium 22 are heated to approximately 120° C. by a single heater, a sufficient aerosol may not be generated in the aerosol substrate section 21.

In this regard, according to an embodiment, the wrapper 25 may include a thermally conductive wrapper so that the aerosol substrate section 21 and the medium 22 may be heated to different temperatures, even when heated by a single heater.

FIGS. 2A and 2B illustrate examples of an aerosol substrate section and a medium wrapped by a thermally conductive wrapper. FIG. 2A illustrates an aerosol substrate section and a medium before being wrapped by a thermally conductive wrapper, and FIG. 2B illustrates a cross-sectional view of an aerosol substrate section and a medium after being wrapped by a thermally conductive wrapper.

Referring to FIGS. 1A to 2B, the wrapper 25 may include a thermally conductive wrapper 30. For example, the thermally conductive wrapper 30 in FIGS. 2A and 2B may correspond to the first wrapper 251 and the second wrapper 252 in FIGS. 1A and 1B. For another example, the thermally conductive wrapper 30 may correspond to the fifth wrapper 255.

The thermally conductive wrapper 30 may be made by coupling a metal foil such as aluminum foil to general filter wrapping paper. For example, the thermally conductive wrapper 30 may be laminated paper of paper and a metal foil.

A heater H of the aerosol generating device may be disposed around the aerosol substrate section 21. For example, a downstream end of the heater H may be aligned with a downstream end of the aerosol substrate section 21. Alternatively, a downstream end of the heater H may be disposed between an upstream end and the downstream end of the aerosol substrate section 21, or may be disposed between an upstream end and a downstream end of the medium 22 as shown in FIG. 2B.

The thermally conductive wrapper 30 may uniformly disperse heat transferred to the aerosol substrate section 21, thereby, increasing heat conductivity of the aerosol substrate section 21.

The heat generated from the heater H may be conducted along the thermally conductive wrapper 30 to be transferred to the medium 22. That is, the aerosol substrate section 21 may directly receive heat from the heater H surrounding the aerosol substrate section 21, and the medium 22 may receive the heat transferred through the thermally conductive wrapper 30. As such, the medium 22 may be heated to a lower temperature than the aerosol substrate section 21. Therefore, the aerosol substrate section 21 and the medium 22 may be heated to different temperatures by the single heater H.

FIGS. 3A and 3B illustrate examples of an aerosol substrate section and a medium wrapped by a thermally conductive wrapper. FIG. 3A illustrate an aerosol substrate section and a medium before being wrapped by a thermally conductive wrapper, and FIG. 3B illustrates a cross-sectional view of the aerosol substrate section and the medium after being wrapped by a thermally conductive wrapper.

Referring to FIGS. 3A and 3B, the thermally conductive wrapper 30 may include a first portion 31 and a second portion 32 that do not overlap each other.

The first portion 31 may be included in the first wrapper (251 in FIG. 1A), and the second portion 32 may be included in the second wrapper (252 in FIG. 1A). Alternatively, the first portion 31 and the second portion may be included in the fifth wrapper (255 in FIG. 1B).

The first portion 31 and the second portion 32 may have different thermal conductivities from each other. For example, the first portion 31 may have a higher thermal conductivity than the second portion 32.

For example, the first portion 31 may contain a thermally conductive material, and the second portion 32 may not contain a thermally conductive material. For example, the first portion 31 may include laminated paper of paper and a thermally conductive material, and the second portion 32 may include only paper. As another example, the first portion 31 may be wrapping paper containing a thermally conductive material, and the second portion 32 may be an empty portion such as a hole.

For example, the first portion 31 may contain a greater amount of thermally conductive material per unit area than the second portion 32. For example, the first portion 31 and the second portion 32 may contain a metal foil as a thermally conductive material, and the first portion 31 contain a thicker metal foil than the second portion 32. For example, the first portion 31 may be composed of wrapping paper containing a thermally conductive material with a higher density than the second portion 32.

For example, the first portion 31 may contain a thermally conductive material with a higher thermal conductivity than the second portion 32. For example, the first portion 31 may contain graphene, silver, or copper as a thermally conductive material, and the second portion 32 may contain aluminum, iron, or a non-metallic material as a thermally conductive material. The first portion 31 and the second portion 32 may be composed of various combinations of thermally conductive materials with different thermal conductivities from each other. For example, when the first portion 31 contains aluminum, the second portion 32 may contain a non-metallic material.

In contrast to the above examples, the second portion 32 may be configured to have a higher thermal conductivity than the first portion 31.

The first portion 31 of the thermally conductive wrapper 30 may surround the aerosol substrate section 21, and the second portion 32 may surround the medium 22. In addition, the heater H of the aerosol generating device may be disposed around the aerosol substrate section 21.

By wrapping the medium 22 with the second portion 32 having a relatively low thermal conductivity, it is possible to reduce heat transfer from the heater H of the aerosol generating device to the medium 22. Therefore, an effect of heating the aerosol substrate section 21 and the medium 22 to different temperatures with a single heater, which is explained with reference to FIGS. 2A and 2B, may be enhanced in the embodiment described with reference to FIGS. 3A and 3B.

Alternatively, by wrapping the medium 22 with the second portion 32 having a relatively high thermal conductivity, heat may be transferred to the medium 22 through the second portion 32 even if the heater H of the aerosol generating device is not disposed to surround the medium 22. Therefore, it is possible to heat the aerosol substrate section 21 and the medium 22 with a single heater.

FIGS. 4A and 4B illustrate examples of an aerosol substrate section and a medium wrapped by a thermally conductive wrapper. FIG. 4A illustrates an aerosol substrate section and a medium before being wrapped by a thermally conductive wrapper, and FIG. 4B illustrates an aerosol substrate section and a medium after being wrapped by a thermally conductive wrapper.

Referring to FIGS. 4A and 4B, the first portion 31 of the thermally conductive wrapper 30 may include a first sub-portion 311 surrounding the aerosol substrate section 21 and a second sub-portion 312 surrounding the medium 22. The remaining part of the medium 22 may be surrounded by the second portion 32.

The first sub-portion 311 may be included in the first wrapper (251 in FIG. 1A), and the second sub-portion 312 and the second portion 32 may be included in the second wrapper (252 in FIG. 1A).

The second sub-portion 312 may extend toward a downstream end of the medium 22 to surround at least a part of the medium 22. In addition, as shown in FIGS. 4A and 4B, a plurality of second sub-portions 312 may be provided, and the plurality of second sub-portions may be spaced apart from each other.

When the heater H of the aerosol generating device is disposed around the aerosol substrate section 21, the upstream end of the medium 22 is disposed closer to the heater H than the downstream end thereof, and thus, the downstream end of the medium 22 may receive less heat than the upstream end thereof. In the embodiment according to FIGS. 4A and 4B, heat may be transferred to the downstream end of the medium 22 through the second sub-portion 312 having a relatively higher thermal conductivity than the second portion 32, and thus, it is possible to prevent the downstream end of the medium 22 from being heated to a lower temperature than the upstream end thereof.

Also, excessive heat may be prevented from being transferred to the medium 22 by employing the second sub-portion 312 that has a relatively lower thermal conductivity than the second portion 32, thereby, preventing the medium 22 from being overheated.

FIGS. 5A and 5B illustrate an example of an aerosol substrate section and a medium wrapped by a thermally conductive wrapper. FIG. 5A illustrates an aerosol substrate section and a medium before being wrapped by a thermally conductive wrapper, and FIG. 5B illustrates the aerosol substrate section and the medium after being wrapped by the thermally conductive wrapper.

Referring to FIGS. 5A and 5B, at least a part of the second sub-portion 312 may not have a constant width. For example, a width of the second sub-portion 312 may increase or decrease toward a downstream end of the medium 22. The width of the second sub-portion 312 may refer to a distance in a direction crossing a longitudinal direction of the aerosol generating article. For example, in FIGS. 5A and 5B, the width of the second sub-portion 312 increases toward a downstream end of the medium 22.

The second sub-portion 312 may have a higher thermal conductivity than the second portion 32. Therefore, areas and positions of the second sub-portion 312 and the second portion 32 in the medium 22 may be adjusted to adjust a degree and a direction of heat transfer to the medium 22.

In the embodiment according to FIGS. 5A and 5B, the width of the second sub-portion 312 increases toward the downstream end of the medium 22, and thus, an area of the medium 22 surrounded by the second sub-portion 312 may also increase toward a downstream end thereof. Therefore, it is possible to compensate for a difference in heat transfer due to a difference in distance between the heater H of the upstream end of the medium 22 and the heater H of the downstream end thereof, thereby heating the entire medium 22 uniformly.

FIGS. 6A and 6B illustrate one example of an aerosol substrate section and a medium wrapped by a thermally conductive wrapper. FIG. 6A illustrates an aerosol substrate section and a medium before being wrapped by a thermally conductive wrapper, and FIG. 6B illustrates a cross-sectional view of the aerosol substrate section and the medium after being wrapped by the thermally conductive wrapper.

Referring to FIGS. 6A and 6B, the second portion 32 may be disposed between the first sub-portion 311 and the second sub-portion 312. In addition, an upstream end of the second portion 32 may be adjacent to an upstream end of the medium 22. In addition, the heater H of an aerosol generating device may be disposed around the aerosol substrate section 21.

The second portion 32 may have a lower thermal conductivity than the first sub-portion 311 and the second sub-portion 312. Therefore, the second portion 32 may perform a function of reducing heat from being transferred from the first sub-portion 311 to the second sub-portion 312. Therefore, the medium 22 may be heated to a lower temperature than the aerosol substrate section 21, and thus, the aerosol substrate section 21 and the medium 22 may be heated to different temperatures by a single heater H. In addition, since an upstream portion of the medium 22 close to the heater H is wrapped by the second portion 32 whereas a downstream portion of the medium 22 distant from the heater H is wrapped by the first portion 312, and it is possible to compensate for a difference in heat transfer due to a difference in distance between the heater H of an upstream end of the medium 22 and the heater H of a downstream end thereof.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating system comprising:

an aerosol generating article for generating aerosol when heated, the aerosol generating article comprising:

an aerosol substrate section containing an aerosol generating material without nicotine;

a medium disposed to face a downstream end of the aerosol substrate section and containing nicotine;

a cooler disposed to face a downstream end of the medium;

a filter disposed to face a downstream end of the cooler; and a thermally conductive wrapper surrounding at least part of the aerosol substrate section and the medium and comprising a first portion and a second portion that do not overlap each other; and a single heater that is configured to generate heat outside of the aerosol generating article that heats the aerosol generating article, wherein the aerosol substrate section is surrounded by the first portion, wherein the medium is surrounded by the second portion or at least part of the first portion and the second portion, wherein each of the first portion and the second portion further comprises a thermally conductive material, and wherein the first portion and the second portion have different thermal conductivities from each other such that the aerosol substrate section and the medium are heated to different temperatures by the single heater through the first portion and the second portion.

2. The aerosol generating system of claim 1, wherein one of the first portion and the second portion has a greater amount of thermally conductive material per unit area than the other of the first portion and the second portion.

3. The aerosol generating system of claim 1, wherein the first portion includes a first sub-portion surrounding the aerosol substrate section and a second sub-portion surrounding part of the medium, wherein each of the first sub-portion and the second sub-portion are thermally conductive, and wherein the second portion surrounds a remaining portion of the medium that is not surrounded by the second sub-portion of the first portion.

4. The aerosol generating system of claim 3, wherein the second sub-portion extends from an upstream end of the medium to a downstream end of the medium.

5. The aerosol generating system of claim 3, wherein at least part of the second sub-portion has a non-uniform width.

6. The aerosol generating system of claim 3, wherein the second portion is disposed between the first sub-portion and the second sub-portion.

7. The aerosol generating system of claim 3, wherein the second sub-portion has a higher thermal conductivity than the second portion.

8. The aerosol generating system of claim 3, wherein the second sub-portion has a lower thermal conductivity than the second portion.

9. The aerosol generating system of claim 5, wherein a width of the part of the second sub-portion in a circumferential direction of the thermally conductive wrapper increases in a downstream direction of the aerosol generating article.

10. The aerosol generating system of claim 6, wherein the second portion has a lower thermal conductivity than the first sub-portion and the second sub-portion.

* * * * *